US007867112B1

(12) United States Patent
Giauque et al.

(10) Patent No.: US 7,867,112 B1
(45) Date of Patent: Jan. 11, 2011

(54) ATHLETIC TRAINING APPARATUS

(76) Inventors: Paul R. Giauque, 4 Briarwood Pl., Fargo, ND (US) 58104; Riley R. Giauque, 4 Briarwood Pl., Fargo, ND (US) 58104

( * ) Notice: Subject to any disclaimer, the term of this patent is extended or adjusted under 35 U.S.C. 154(b) by 0 days.

(21) Appl. No.: 12/557,155

(22) Filed: Sep. 10, 2009

Related U.S. Application Data

(60) Provisional application No. 61/096,001, filed on Sep. 11, 2008.

(51) Int. Cl.
*A63B 69/00* (2006.01)

(52) U.S. Cl. ..... 473/446; 473/422

(58) Field of Classification Search ..... 473/422, 473/446, 471, 588, 573, 560; D21/710
See application file for complete search history.

(56) References Cited

U.S. PATENT DOCUMENTS

| | | | | | |
|---|---|---|---|---|---|
| 2,425,966 | A * | 8/1947 | Tjomsland | 473/588 |
| 2,727,744 | A * | 12/1955 | Watson | 473/588 |
| 3,415,522 | A * | 12/1968 | Bauer | 473/471 |
| 3,997,164 | A * | 12/1976 | White, Sr. | 473/588 |
| 4,283,054 | A * | 8/1981 | Patella et al. | 273/126 R |
| 4,555,114 | A * | 11/1985 | Dozier | 473/588 |
| 5,116,064 | A * | 5/1992 | Corlett | 473/446 |
| 5,240,251 | A * | 8/1993 | Filice | 473/588 |
| 5,284,343 | A * | 2/1994 | Bigornia et al. | 473/446 |
| 5,465,966 | A * | 11/1995 | La Savio | 473/588 |
| 5,482,274 | A * | 1/1996 | Bellehumeur | 473/588 |
| 6,638,186 | B2 * | 10/2003 | Williams | 473/446 |
| 2002/0032084 | A1 * | 3/2002 | Hammett | 473/446 |
| 2005/0124440 | A1 * | 6/2005 | Folz | 473/446 |
| 2006/0063615 | A1 * | 3/2006 | Richardson et al. | 473/446 |
| 2008/0287224 | A1 * | 11/2008 | Salvador et al. | 473/446 |

FOREIGN PATENT DOCUMENTS

CH 603179 A5 * 8/1978

* cited by examiner

*Primary Examiner*—Mitra Aryanpour
(74) *Attorney, Agent, or Firm*—Neustel Law Offices

(57) ABSTRACT

An athletic training apparatus for improving the stick and ball handling ability of an athlete and particularly an ice hockey player. The athletic training apparatus generally includes a body member having an upper surface, a flat bottom surface, and a generally circular side wall, wherein the body member is comprised of a cylindrical shape and at least one elongated attachment member extending below the bottom surface of the body member to affix the body member to an athletic training surface, such as a sheet of ice for ice hockey training. Pads may also be secured to the attachment member below the bottom surface of the body member for providing a gripping structure to secure the body member to a surface, such as a roller hockey playing surface. Alternate uses may be employed, such as use upon a court to improve ball handling skills and various other playing surfaces.

1 Claim, 9 Drawing Sheets

ATHLETIC TRAINING APPARATUS

CROSS REFERENCE TO RELATED APPLICATIONS

I hereby claim benefit under Title 35, United States Code, Section 119(e) of U.S. provisional patent application Ser. No. 61/096,001 filed Sep. 11, 2008. The 61/096,001 application is currently pending. The 61/096,001 application is hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to athletic training and more specifically it relates to an athletic training apparatus for improving the stick and ball handling ability of an athlete and particularly an ice hockey player.

2. Description of the Related Art

Any discussion of the related art throughout the specification should in no way be considered as an admission that such related art is widely known or forms part of common general knowledge in the field.

Hockey stick handling and skating drills have been performed for years. Typically, a plurality of roadway cones are spaced upon a sheet of ice or other surface and hockey players skate around the cones and/or maneuver a hockey puck around the cones with their hockey stick.

A common problem associated with this method of practice is that the cones are easily tipped over or moved out of place from engagement with the player's skates, hockey stick, or hockey puck. The coach or player must then reorient the cones to the proper positioning for the next player to utilize the practice setup. This can be very time consuming thus wasting valuable practice time because the cones are very easily knocked over or moved even when experience hockey players are utilizing them. Because of the inherent problems with the related art, there is a need for a new and improved athletic training apparatus for improving the stick and ball handling ability of an athlete and particularly an ice hockey player.

BRIEF SUMMARY OF THE INVENTION

A system for improving the stick and ball handling ability of an athlete and particularly an ice hockey player. The invention generally relates to a training apparatus which includes a body member having an upper surface, a flat bottom surface, and a generally circular side wall, wherein the body member is comprised of a cylindrical shape and at least one elongated attachment member extending below the bottom surface of the body member to affix the body member to an athletic training surface, such as a sheet of ice for ice hockey training. Pads may also be secured to the attachment member below the bottom surface of the body member for providing a gripping structure to secure the body member to a surface, such as a roller hockey playing surface. Alternate uses may be employed, such as use upon a court to improve ball handling skills and various other playing surfaces.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
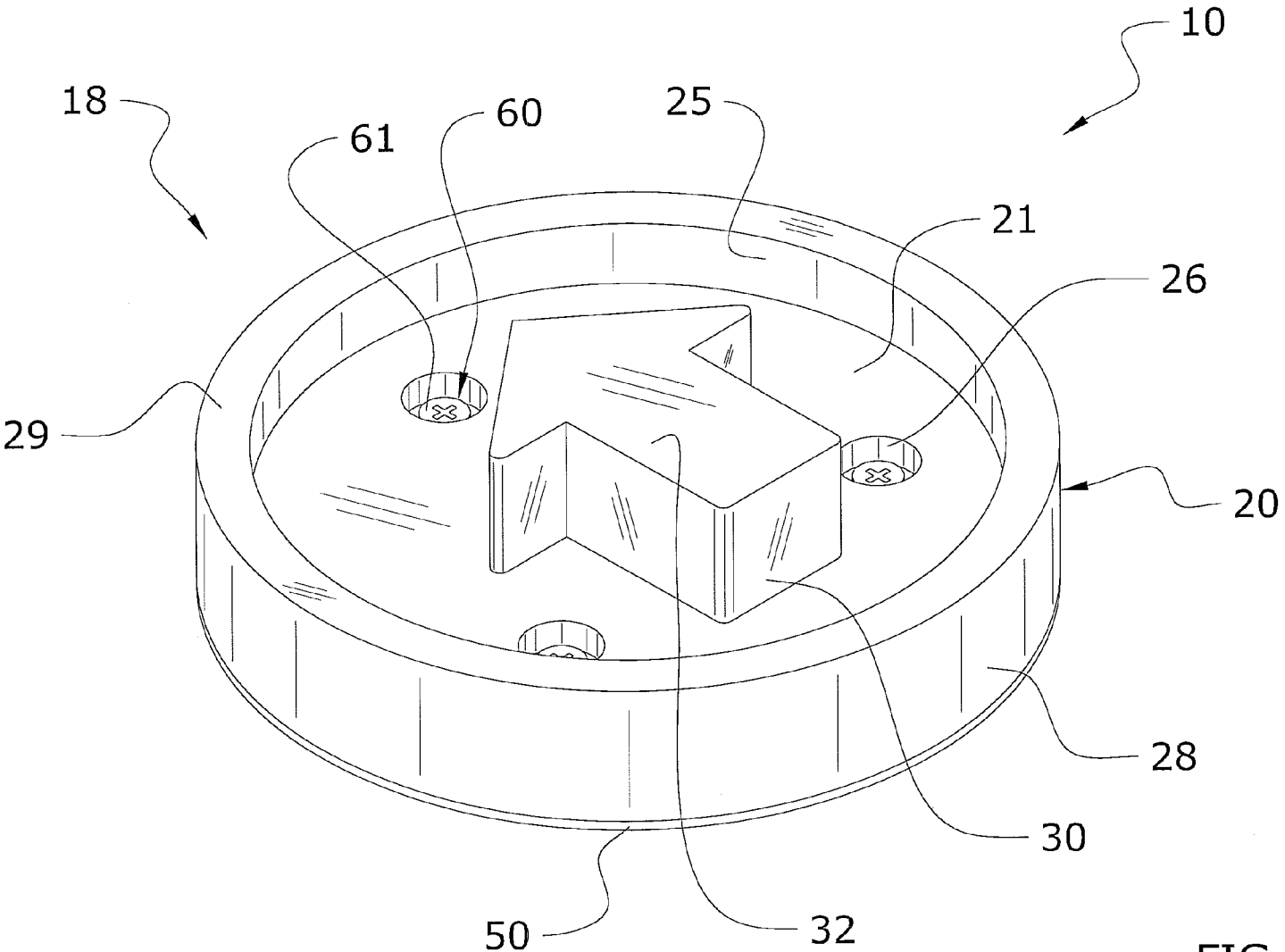
FIG. 1 is an upper perspective view of the present invention with the indicator comprising a first embodiment.
Figure 2:
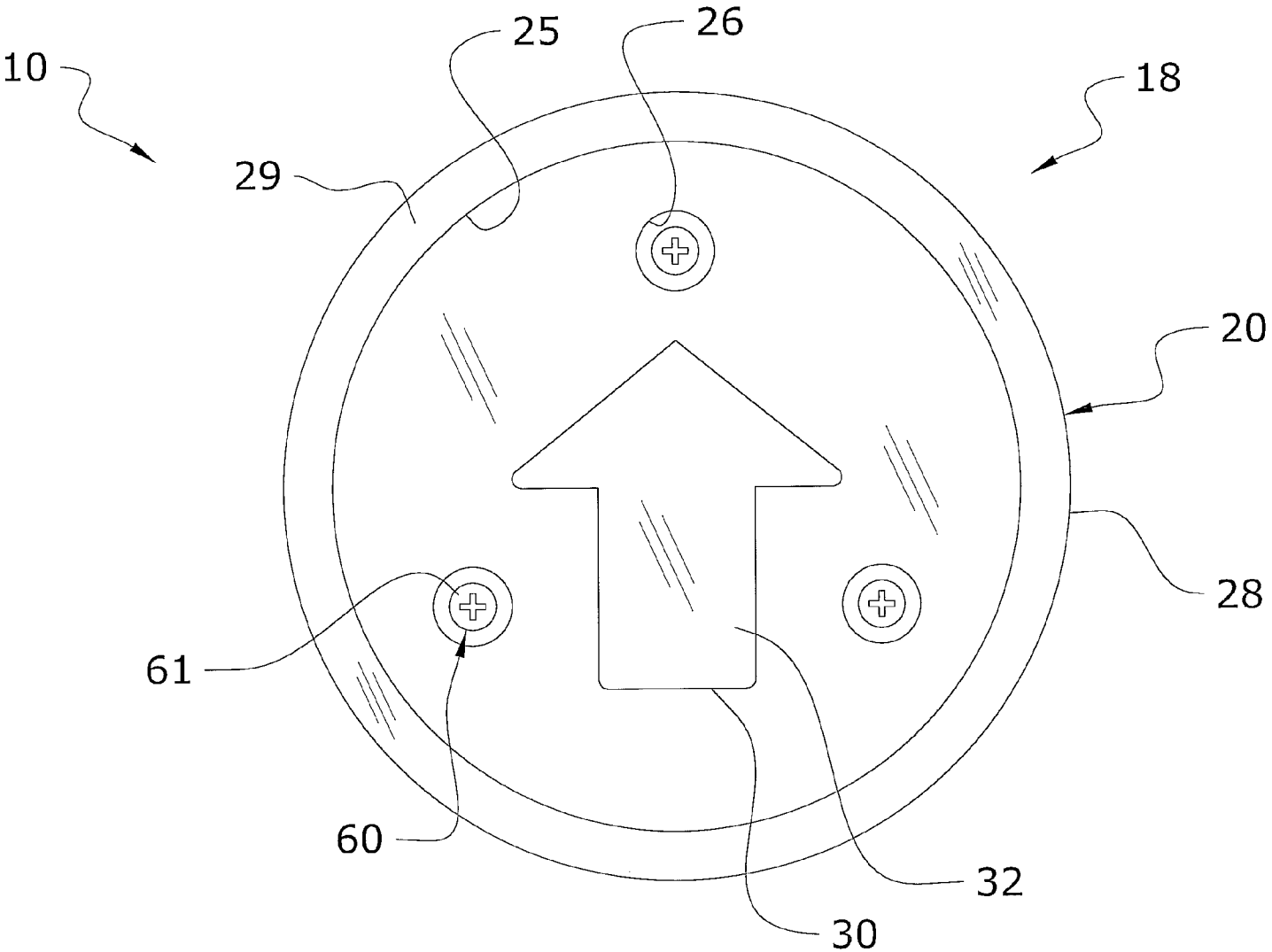
FIG. 2 is a top view of the present invention as shown in FIG. 1.
Figure 3:
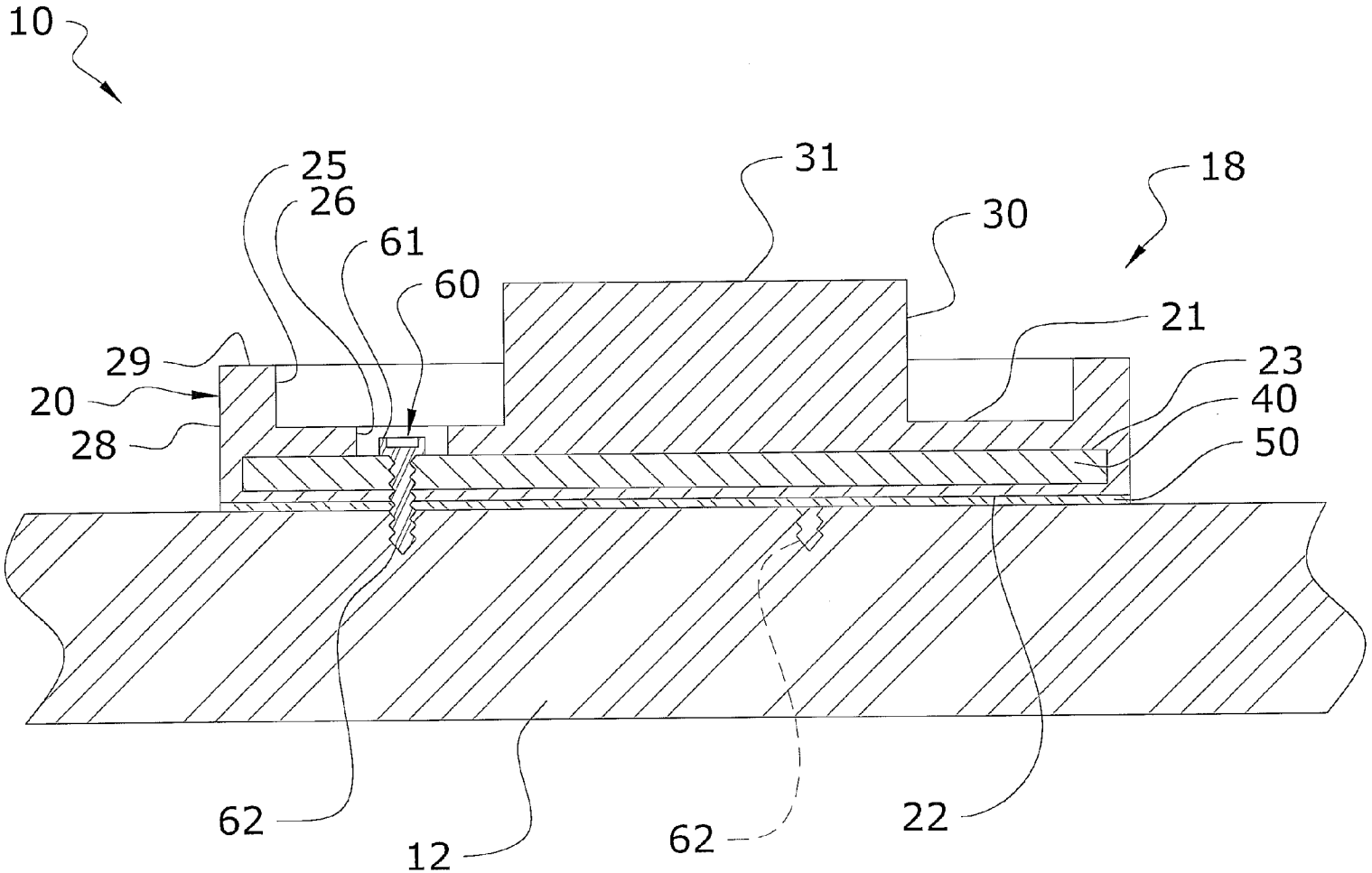
FIG. 3 is a cross-sectional view of the first embodiment affixed to an athletic training surface, such as a sheet of ice for ice hockey players.
Figure 4:
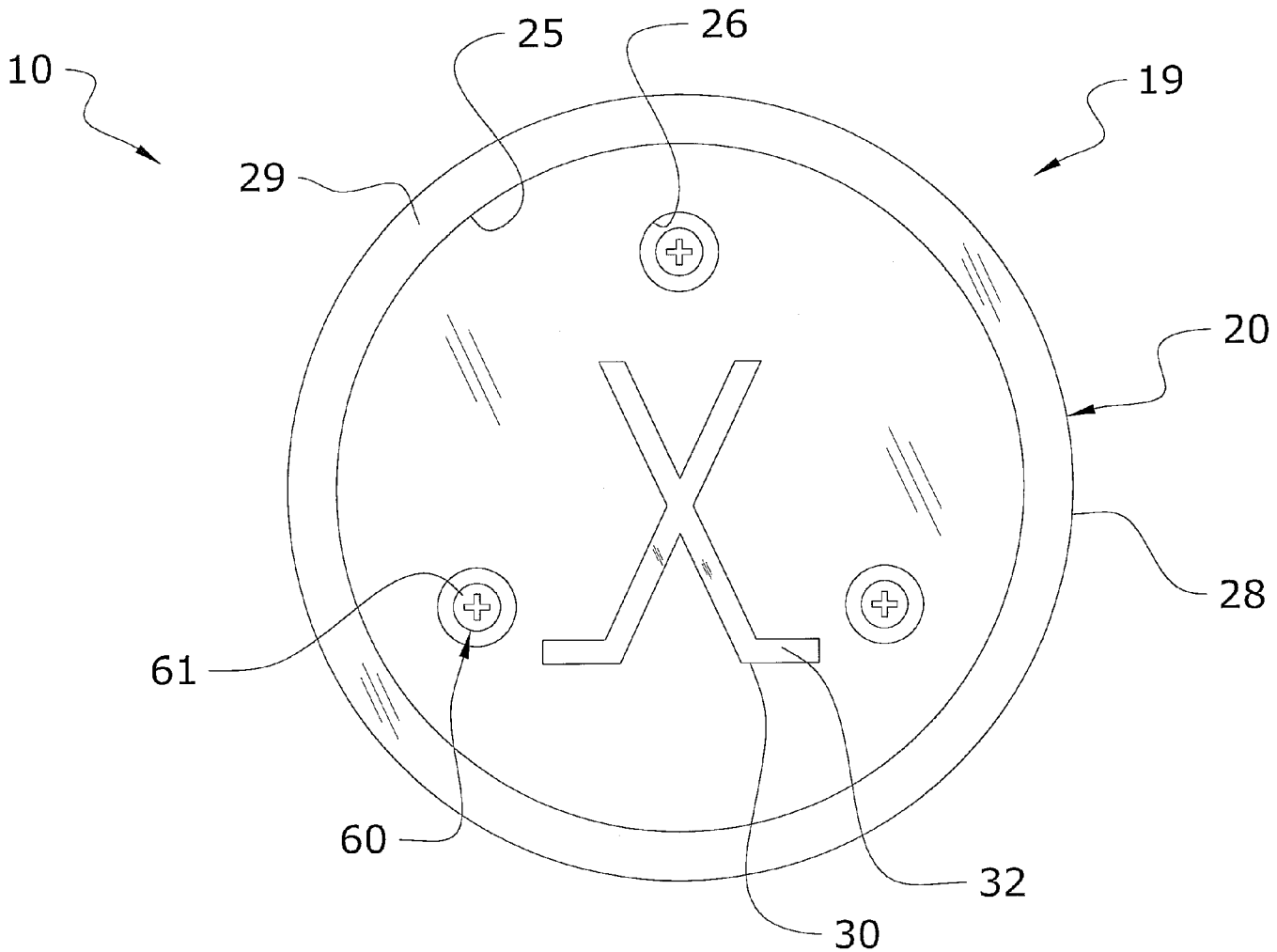
FIG. 4 is a top view of the present invention with the indicator comprising a second embodiment.
Figure 5:
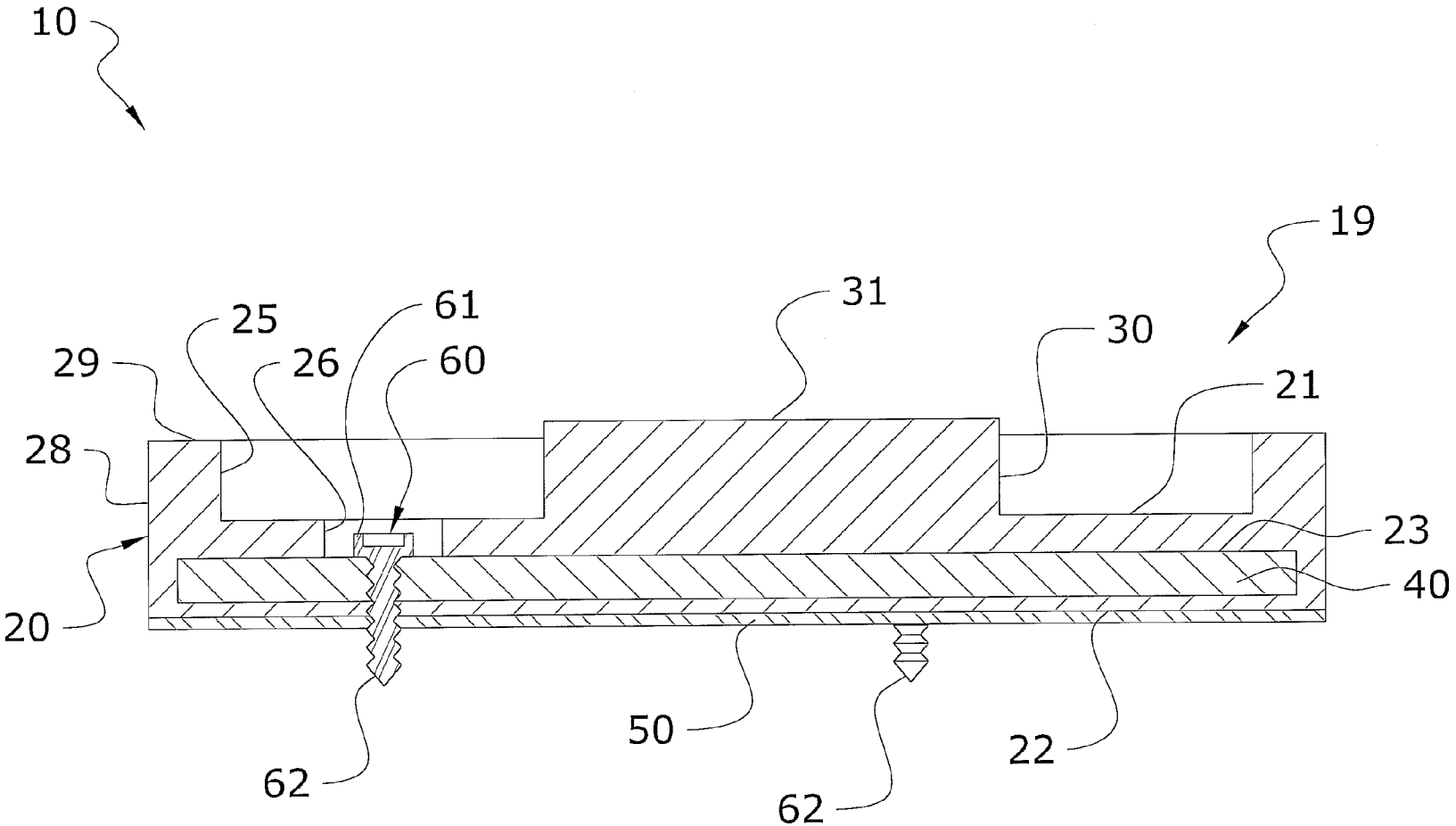
FIG. 5 is a cross-sectional view of the second embodiment as shown in FIG. 4.
Figure 6:
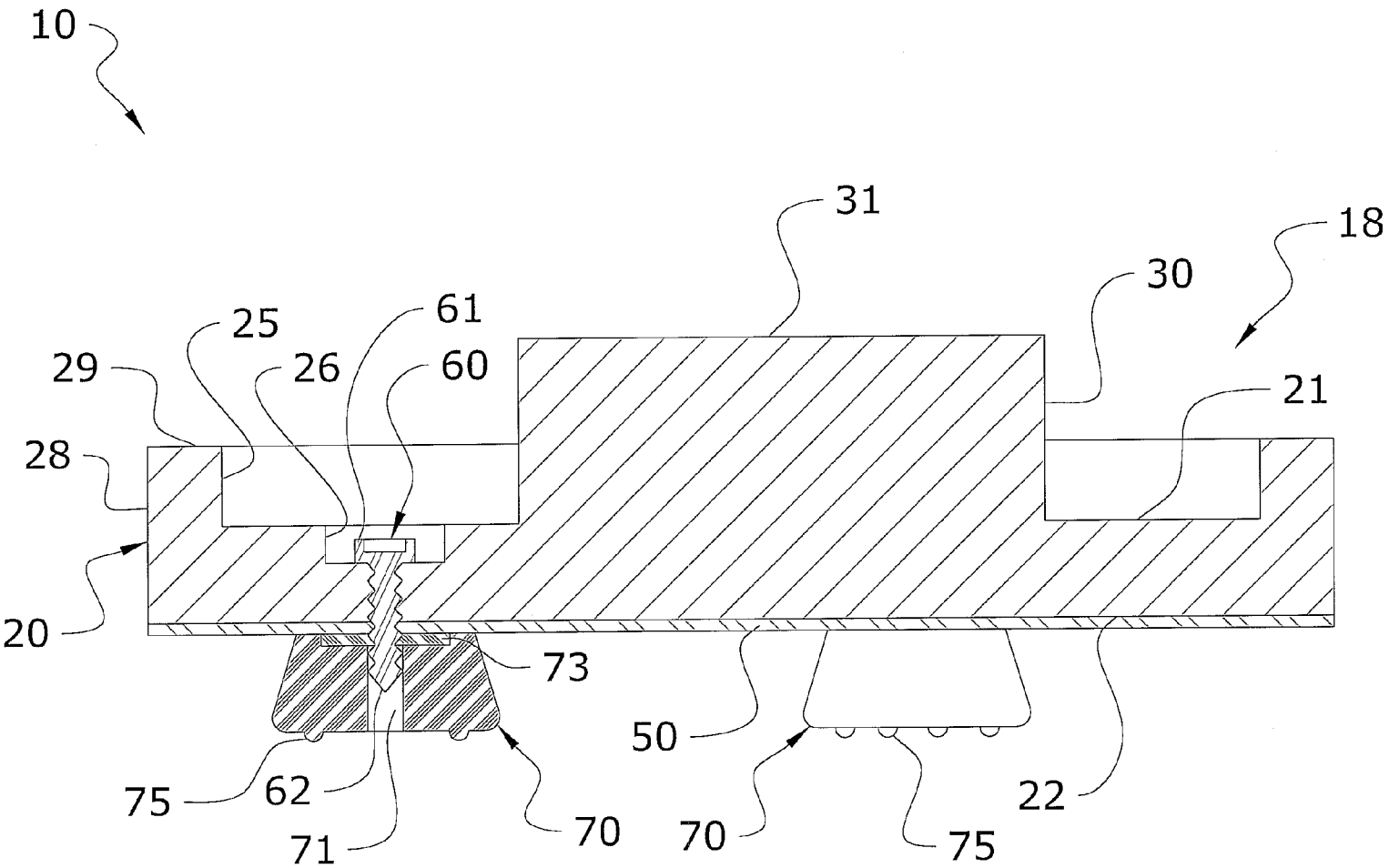
FIG. 6 is a cross-sectional view of the present invention having a plurality of gripping pads attached to the attachment screws for use upon training surfaces other than ice.
Figure 7:
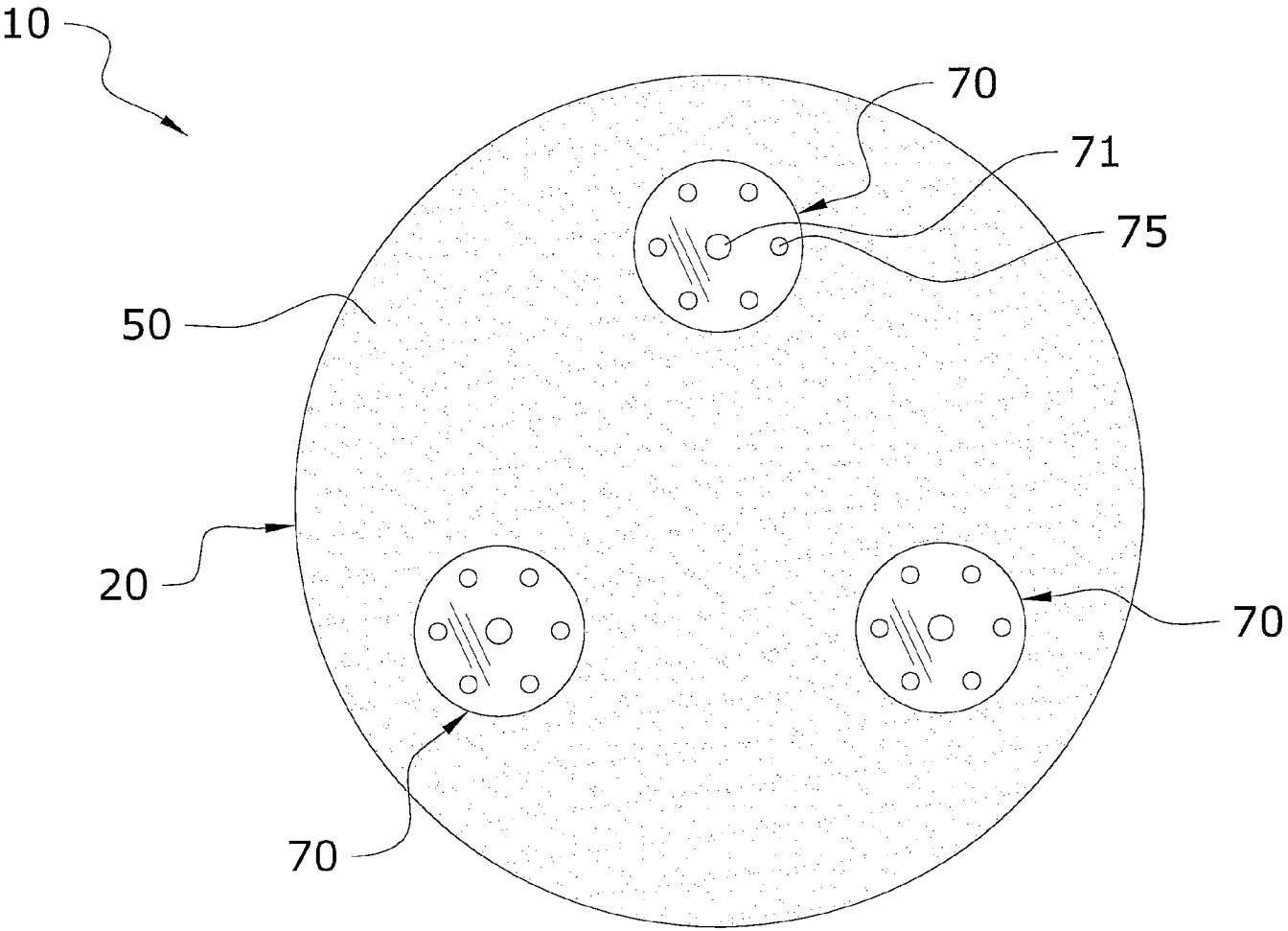
FIG. 7 is a bottom view of the present invention as shown in FIG. 6.

Turning now descriptively to the drawings, in which similar reference characters denote similar elements throughout the several views, FIGS. 1 through 9 illustrate an athletic training apparatus 10, which comprises a body member 20 having an top surface, a flat bottom surface 22, and a generally circular side wall 28, wherein the body member 20 is comprised of a cylindrical shape and at least one elongated attachment member 60 extending below the bottom surface 22 of the body member 20 to affix the body member 20 to an athletic training surface 12, such as a sheet of ice for ice hockey training. Pads 70 may also be secured to the attachment member 60 below the bottom surface 22 of the body member 20 for providing a gripping structure to secure the body member 20 to a surface, such as a roller hockey playing surface. Alternate uses may be employed, such as use upon a court to improve ball handling skills and various other playing surfaces.

B. Body Member

The body member 20 is generally small in size and lightweight to be easily carried within the carrying bag of an athlete or coach from or to practice and/or games. The body member 20 further resembles a puck in size and shape. In addition, the body member 20 is preferably 1 to 1.4 pounds in total weight which is heavy enough to provide stability to the body member 20 while positioned or affixed to the training surface 12, yet light enough to be easily carried between locations.

In the preferred embodiment, the body member 20 is generally comprised of a rubber material and includes a metal weighted insert 40. However, the body member 20 may also be comprised of aluminum or metal material, as well as various other types of materials.

A majority of the top surface is recessed as illustrated by reference numeral 21, as well as a portion of the top surface being raised along the projecting rim 29 and projecting center 30. Each portion of the top surface is generally flat in structure. The bottom surface 22 is also generally flat in structure to rest in a flush manner upon the athletic training surface 12 or alternately evenly receive an insulating pad 50 which will be described in a subsequent section. The sidewalls 28 of the body member 20 are generally circular in shape and extend above the recessed top surface 21 via a vertically projecting rim 29. The overall shape of the body member 20 is thus generally cylindrical as stated earlier to resemble an ice hockey puck. The sidewalls 28 may also include ridges or ribs. It is appreciated that the body member 20 may be various other shapes.

The body member 20 includes the primary recess 25 which extends inwardly within the body member 20 radially between the projecting rim 29 and the projecting center 30. The primary recess 25 is formed within the body member 20 for a primary purpose of altering the weight of the body member 20. However, the primary recess 25 may serve other purposes as desired.

The recessed top surface 21 and the bottom surface 22 form a cavity 23 therebetween in one embodiment of the present invention to receive a weighted insert 40. The cavity 23 may be comprised of various shapes and sizes all which match the shape of the insert 40. Further, a plurality of secondary recesses 26 extend within the recessed top surface 21 for receiving the head 61 of the attachment members 60, wherein the secondary recesses 26 primarily function as counter bores to ensure that the head 61 of the attachment member 60 does not protrude vertically upwards from the recessed top surface 21.

The body member 20 also includes the projecting center 30 which extends vertically upwards from the recessed top surface 21 and is centrally located upon the body member 20. The projecting center 30 may vertically extend to a point flush with the projecting rim 29 or above the projecting rim 29. In the preferred embodiment, the projecting center 30 extends further vertically upward for a first embodiment 18 than the second embodiment 19.

The first embodiment 18 is generally used at the start of a series of apparatuses 10 to indicate to the athlete where the starting point in relation to a plurality of apparatuses 10 and at what location relative the starting apparatus 10 represented by embodiment 18 the athlete should start at. Each of the projecting centers 30 thus generally include an indicator 32 and may be formed in the shape of a three-dimensional structure integral with the projecting center 30.

The first embodiment 18 includes an indicator 32 and projecting center 30 shaped in the form of an arrow. The second embodiments 19 have an indicator 32 and projecting center 30 shaped in the form of a pair of crossed hockey sticks. Other shapes of indicators 32 and/or projecting centers 30 may be used with various other embodiments of the present invention and to mimic various other types of sports.

It is appreciated that generally only one of the apparatuses 10 of a series needs an indicator 32 shaped as an arrow, such as in the first embodiment 18, since only a starting position needs to be labeled. If all the apparatuses 10 had arrows as indicators 32, time would be wasted setting up for practice drills since each apparatus 10 would have to be oriented to the correct rotational position. The structure of the first embodiment 18 of the apparatus 10 and the second embodiment 19 of the apparatus 10 20 is preferably the same with only the indicators 32 and possibly projecting centers 30 differing.

C. Weighted Insert

The weighted insert 40 may be positioned within the cavity 23 of the body member 20 to add additional weight to the body member 20. In one embodiment, where the body member 20 is comprised of a rubber material, the weighted insert 40, being comprised of a metal or heavier material than rubber, is positioned within the cavity 23.

In another embodiment, where the body member 20 is comprised of a metal, the insert may be omitted and the cavity 23 simply not formed within the body member 20 if the body member 20 is already a desired weight. The weighted insert 40 may also include openings for allowing passage through of the attachment members 60.

D. Insulating Pad

The insulating pad 50 is affixed, through the use of adhesive or other compounds or elements to the bottom surface 22 of the body member 20. The insulating pad 50 is thus positioned between the bottom surface 22 and the athletic training surface 12 (e.g. ice surface) during use of the present invention. The insulating pad 50 assists in preventing the bottom surface 22 from freezing to the ice surface by creating a barrier to control the temperature variation between the ice and the body member 20. The insulating pads 50 are preferably circular to match the shape of the bottom surface 22.

The insulating pad 50 further provides additional grip for the body member 20, wherein the insulating pad 50 is preferably comprised of a gritty structure, such as sandpaper. The insulating pads 50 may further be comprised of various types of sandpaper, such as 40-80 grit.

It is appreciated that in some embodiments, the insulating pad 50 may be more useful than others, such as when the bottom surface 22 of the body member 20 is comprised of steel rather rubber, wherein steel may inherently freeze to the ice and have less gripping ability than rubber. However, the insulating pad 50 is preferably used with all embodiments of the present invention where the need for additional grip 75 and/or the ability to prevent the body member 20 from freezing or sticking to the athletic training surface 12 is present. The insulating pads 50 may also be a different color than the body member 20.

E. Attachment Members

The attachment members 60 are preferably used to affix the body member 20 to the athletic training surface 12 by penetrating the ice 12 to keep the body member 20 stationary. In the preferred embodiment, the attachment members 60 are comprised of self-tapping threadable fasteners, screws, or spikes, bike tire studs, nails, all of which are extended through the body member 20 so that the head 61 of the attachment member 60 is positioned within a respective secondary recess 26. The attachment members 60 may be comprised of various sizes, such as ½" in length and grade 5 or above.

The generally sharp tip 62 of the attachment member 60 extends through the bottom surface 22 and insulating pad 50 sufficiently to extend within the athletic training surface 12 (e.g. ice) and rigidly affix the body member 20 thereto. The head 61 of the attachment member 60 is accessible from the top surface 21 of the body member 20 within the secondary recess 26 to allow tightening and loosening of the body member 20 against the training surface 12 while positioned thereon.

The body member 20 is thus prevented from moving if engaged by an athlete while performing a practice drill. It is appreciated that one or multiple attachment members 60 may be used with the present invention all which are necessary for rigidly affixing the body member 20 to the athletic training surface 12.

F. Gripping Pads

In alternate environments of using the present invention, the attachment members 60 may be desired to not penetrate the athletic training surface 12, such as when being used for roller hockey. In these circumstances, the attachment members 60 are still extended through the body member 20 and bottom surface 22; however the attachment members 60 are each covered with a separate gripping pad 70. The gripping pad 70 is generally comprised of a rubber material to grip 75 the training surface 12. The gripping pads 70 may be rotatably attached to the attachment members 60 or attached in various other manners.

The gripping pad 70 is generally conical in shape with the larger diameter end engaging the training surface 12 so as to provide more surface area for gripping. The pads each include a channel 71 for receiving the portion of the attachment member 60 extending below the bottom surface 22 of the body member 20. The channel 71 and pad 70 are longer in length than the portion of the attachment member 60 extending below the bottom surface 22 to prevent the attachment member 60 from engaging the training surface 12.

The pads 70 may also each include a securing member 73, such as a flat nut or rigid element for the attachment member 60 to threadably screw into and retain the pad 70 to the attachment member 60 and tightly against the bottom surface 22 of the body member 20 or insulating pad 50. In addition, each of the pads 70 preferably include a plurality of grips 75 vertically extending from a lower end for ultimately engaging the training surface 12. The grips 75 are preferably comprised of a rubber material and are integrally formed with the pads 70. The grips 75 may form a circular arrangement as illustrated or various other configurations.

G. Operation of Preferred Embodiment

In use, the first or starting embodiment 18 of the present invention is positioned at a start location and the indicator 32 is directed in a direction to where the hockey puck is to be positioned to indicate a start position. The second or following embodiments 19 of the present invention are then positioned in a spaced apart manner following the starting embodiment 18.

Figure 8:
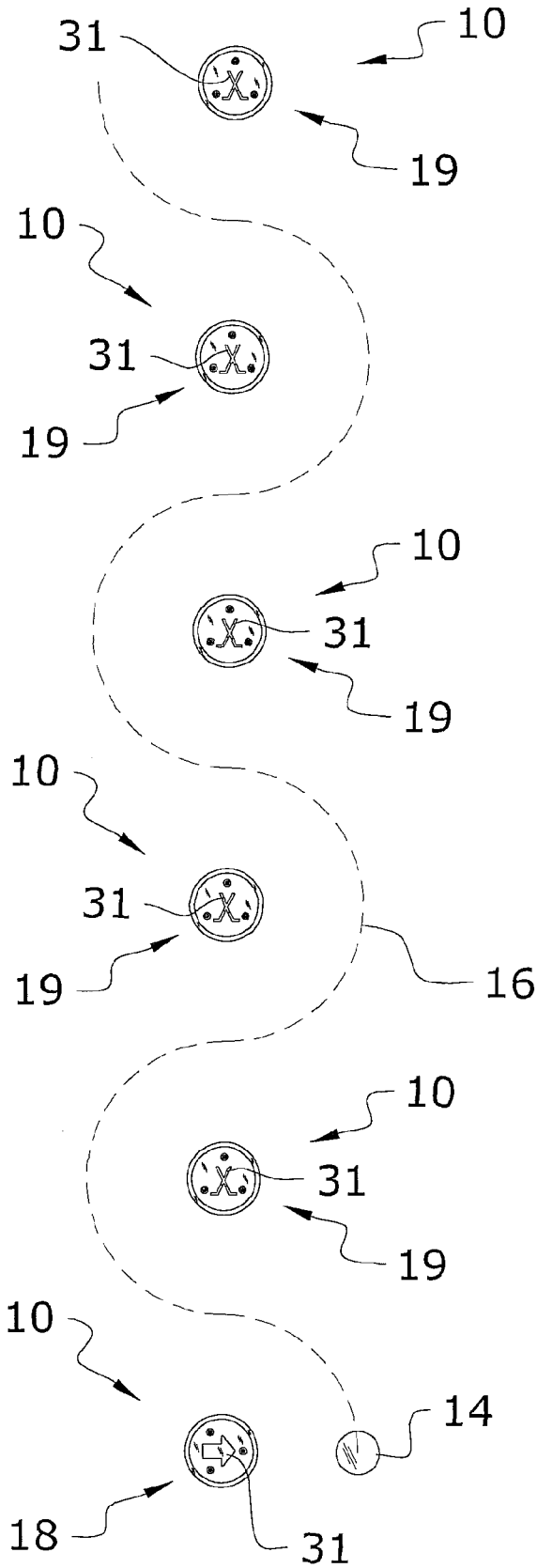
FIG. 8 is an exemplary illustration of the present invention setup for training purposes and a possible path for the hockey player to route the hockey puck.
Figure 9:
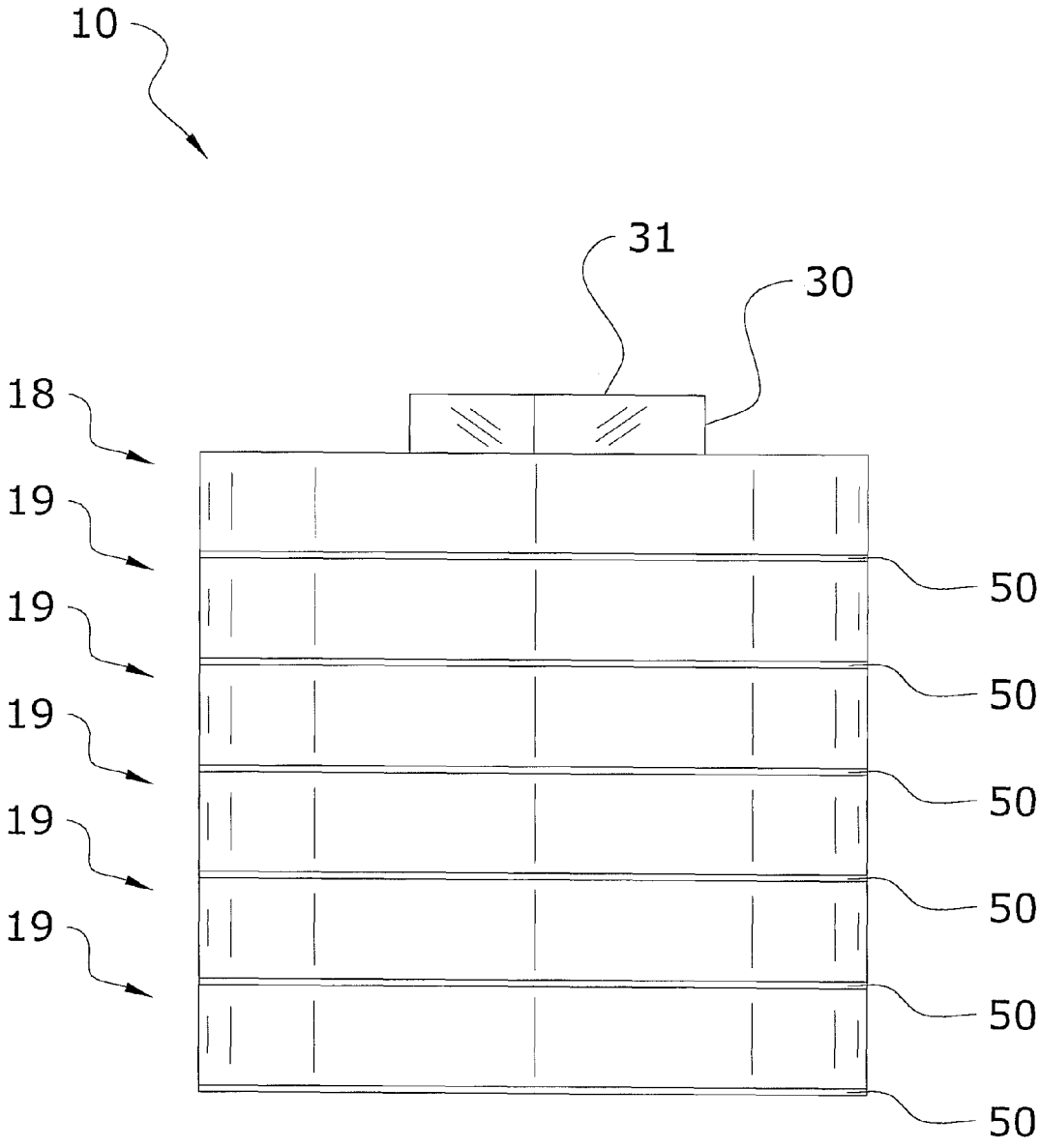
FIG. 9 is a side view of a plurality of apparatuses stacked upon each other.

One illustration of an arrangement for using the present invention is illustrated in FIG. 8. However, it is appreciated that various other arrangements may be utilized. FIG. 8 also illustrates a possible path 16 for the hockey player to maneuver the puck 14 while utilizing the present invention. It is appreciated that the first embodiment 18 and the second embodiment 19 may also be different colors for distinguishing, such as red for the first embodiment 18 and blue for the second embodiment 19.

The present invention is securely affixed to the ice 12 via threadably extending the attachment members 60 through the body member 20 and into the ice 12. A kit may also be included with illustrations and diagrams on how to utilize the present invention and possible setups for training purposes. Each of the apparatuses 10 (first and second embodiments 18, 19) are also preferably stackable upon each other for easier carrying of the present invention.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. In case of conflict, the present specification, including definitions, will control. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A hockey stick handling training apparatus, comprising:

a body member having a top surface, a bottom surface, and a generally circular side wall, wherein said body member is comprised of a generally cylindrical shape;

wherein said bottom surface is substantially flat;

wherein said body member includes a projecting rim comprising a perimeter of said body member;

wherein said body member includes a projecting center;

wherein said projecting center comprises an indicator;

wherein said top surface is recessed between said projecting rim and said projecting center;

a plurality of attachment members extending through said body member;

wherein said plurality of attachment members include a head accessible from said top surface of said body member and a tip extending below said bottom surface to affix said body member by extending within a sheet of ice;

wherein said plurality of attachment members are comprised of a threadable screw;

an insulating pad covering said bottom surface;

wherein said body member includes a cavity between said top surface and said bottom surface; and a weighted insert positioned within said cavity.

* * * * *